US006648993B2

(12) United States Patent
Hashiguchi

(10) Patent No.: US 6,648,993 B2
(45) Date of Patent: Nov. 18, 2003

(54) CASTINGS FROM ALLOYS HAVING LARGE LIQUIDIUS/SOLIDUS TEMPERATURE DIFFERENTIALS

(75) Inventor: Don H. Hashiguchi, University Hts., OH (US)

(73) Assignee: Brush Wellman, Inc., Cleveland, OH (US)

( * ) Notice: Subject to any disclaimer, the term of this patent is extended or adjusted under 35 U.S.C. 154(b) by 29 days.

(21) Appl. No.: 09/797,465

(22) Filed: Mar. 1, 2001

(65) Prior Publication Data

US 2002/0162611 A1 Nov. 7, 2002

(51) Int. Cl.[7] ..... C22F 1/08
(52) U.S. Cl. ..... 148/539; 148/554
(58) Field of Search ..... 148/522, 538, 148/539, 554; 419/49, 68

(56) References Cited

U.S. PATENT DOCUMENTS

| | | | | |
|---|---|---|---|---|
| 4,250,610 A | * | 2/1981 | Wilbers et al. | 148/522 |
| 5,213,252 A | * | 5/1993 | Eylon | 148/670 |
| 5,551,997 A | * | 9/1996 | Marder et al. | 419/68 |
| 6,146,477 A | * | 11/2000 | Clark et al. | 148/539 |

FOREIGN PATENT DOCUMENTS

| | | |
|---|---|---|
| GB | 1 520 923 A | 8/1978 |
| JP | 07 011482 A | 1/1995 |
| JP | 08 269653 A | 10/1996 |
| WO | WO 96 41033 A | 12/1996 |

OTHER PUBLICATIONS

*Binary Alloy Phase Diagrams*, vol. 2, Thaddeus B. Massalski, editor–in–chief, ASM, 1986, p. 1598.*

Kirk Othmer, *Concise Encyclopedia of Chemical Technology*, Copper Alloys, pp. 318–322, 3d. Ed, ©1985.

Application Data Sheet, "Standard Designation for Wrought and Cast Copper and Copper Alloys," rev. 1999, Copper Dev. Assn.

Harkness et al., Beryllium–Copper and Other Beryllium–Containing Alloys, *Metals Handbook*, vol. 2, 10$^{th}$ Ed., ©1993 ASM Int'l.

William Nielsen, Jr. et al., "Unwrought Continuous Cast Copper–Nickel–Tin Spinodal Alloy," U.S. Patent Appln. No. 08/552,582, filed Nov. 3, 1995.

Zhang, Jing Guo et al., "Properties and Microstructure of Cu–15Ni–8Sn Alloy Prepared by Spray Forming," Chemical Abstracts of Columbus, Ohio, U.S., retrieved from STN Database accession No. 128:207778 CA abstract, and Thermec '97 Int'l. Conf. on Thermomechanical Processing of Steels and Other Materials, 2nd, Jul. 11, 1997, pp. 1721–1729, vol.. 2, Minerals, Metals & Materials Socie. Wollongong, Australia.

Schmidt, R.F. et al., "Copper and Copper Alloys," *Metals Handbook*, vol. 15, Casting, 1988, pp. 771–776, ASM Int'l., Ohio, U.S.

* cited by examiner

*Primary Examiner*—George Wyszomierski
(74) *Attorney, Agent, or Firm*—Calfee, Halter & Griswold, LLP

(57) ABSTRACT

The casting porosity of an unwrought casting made from an alloy having a large difference between its liquidus and solidus temperatures is reduced by subjecting the casting to hot isostatic pressing.

6 Claims, No Drawings

CASTINGS FROM ALLOYS HAVING LARGE LIQUIDIUS/SOLIDUS TEMPERATURE DIFFERENTIALS

BACKGROUND

1. Field of the Invention

The present invention relates to castings made from alloys having large differentials between their liquidus and solidus temperatures.

2. Background

Cast products are typically not used in applications that can result in major catastrophe, especially where service failure cannot be predicted. For example, because of their low fatigue properties, castings are typically not used for making structural aircraft components. Similarly, castings are typically not used for making commercial hand tools, high speed tools and bearing steels because of poor mechanical and fracture toughness problems.

One reason why castings are not used in these applications is casting porosity. Casting porosity can result from a number of different phenomena including liberation of gas during solidification from the molten state, which is commonly referred to as "gas porosity." Casting porosity can also be due to shrinkage of the liquid metal during solidification without sufficient flow of liquid metal into the solidifying region, which is commonly referred to as "interdendritic" or "shrink porosity."

Casting porosity can be an especially significant problem in alloys having large differentials between their liquidus and solidus temperatures, e.g. differentials on the order of 100° C. or more. By "liquidus temperature" is meant the temperature at the alloy becomes 100% liquid upon heating. "Solidus temperature" is that temperature at which the alloy becomes 100% solid when cooled. Such "high freezing range" alloys inherently take longer to cool from 100% molten to 100% solid. This, in turn, allows increased casting porosity to occur, since casting porosity occurs only during solidification—i.e., while the alloy is in a semi-solid state between its liquidus and solidus temperatures. Moreover, because cooling time is directly related to casting size, shrink porosity can become especially pronounced when castings made from these alloys are larger in size, e.g. castings whose minimum thickness dimension is 1 inch or more.

Accordingly, it is an object of the present invention to provide new technology for making alloy castings with reduced casting porosity.

In addition, it is a further object of the present invention to provide such reduced porosity alloy castings even when made from alloys having large differentials between liquidus and solidus temperatures.

A still further object of the present invention is to provide such improved low porosity castings when made from such large differential alloys, even when the casting has a minimum thickness dimension of 1 inch or more.

SUMMARY OF THE INVENTION

These and other objects are accomplish by the present invention which is based on the discovery that casting porosity can be largely reduced, and essentially eliminated in some instances, by subjecting the casting to hot isostatic pressing ("HIP").

Accordingly, the present invention provides a new process for reducing casting porosity in a casting made from an alloy having a solidus/liquidus temperature differential of at least 50° C. comprising subjecting the casting to hot isostatic pressing.

In addition, the present invention provides a new casting made from an alloy having a solidus/liquidus temperature differential of at least 50° C., the casting having a minimum thickness dimension of 1 inch and further having a casting porosity of 50% or less of the porosity of an otherwise identical casting not having been subjected to hot isostatic pressing.

DETAILED DESCRIPTION

In accordance with the present invention, the casting porosity of a casting made from an alloy having a large differential between its liquidus and solidus temperatures (hereinafter "high freezing range alloy") is reduced and/or essentially eliminated by subjecting the casting to hot isostatic pressing.

Castings

The present invention is applicable to any type of casting including bulk castings and near net shape castings. In this context, a "bulk casting" is a mass of solid alloy whose size and shape are dictated by convenience in terms of manufacture, storage and use. Bulk castings are sold commercially in a variety of different forms including rods, bars, strips and the like. Transforming these bulk products into discrete, shaped products in final form usually requires some type of substantial shaping operation for imparting a significant change in shape to the casting. This significant change in shape may occur by some type of cutting operation for removing part of the casting and may also include a mechanical deformation step such as bending or forging for imparting a curved or other non-uniform, non-rectilinear or non-orthogonal shape to the casting. In some instances, the casting may be worked, before or after final solution anneal, to affect its crystal structure throughout its bulk.

A "near net shape" casting, on the other hand, is a casting whose shape when taken out of the mold is the same as, or approximately the same as, the shape of the ultimate product to be made. Only minor shaping, in addition to removing the sprues, gates, runners and hot tops and deburring the casting surfaces, is required to achieve final shape. Such minor shaping may include some type of cutting operation (e.g. drilling, sawing, milling, etc.) to impart holes or other fine shape changes to the casting body. Wrought processing, as further described below, is not involved. Where the ultimate product is small, a single near net shape casting may be composed of multiple near net shape sections which are separated from one another to form the ultimate products.

Skilled metallurgists readily understand the difference between "bulk" and "near net shape" castings.

The present invention is primarily directed to making improved castings (both bulk and near net shape) which are unwrought. In this connection, it is well understood in metallurgy that the crystal structure and hence properties of many alloys can be significantly affected by subjecting the alloy to substantial, uniform mechanical working (deformation without cutting), typically on the order of 40% or more in terms of area reduction. Accordingly, most alloys of this type are available commercially either in wrought (worked) form or in cast (unwrought) form. See, for example, Kirk Othmer, *Concise Encyclopedia of Chemical Technology*, Copper Alloys, pp 318–322, 3d. Ed., © 1985. See, also, the APPLICATION DATA SHEET, Standard Designation for Wrought and Cast Copper and Copper Alloys, Revision 1999, published by the Copper Development Association. The present invention is primarily applicable to unwrought castings—i.e., castings which have not been subjected to mechanical deformation carried out to effect a noticeable change in the crystal structure and properties of the alloy forming the casting.

The present invention can also be used to enhance the properties of a previously wrought processed casting—i.e., a casting which has already been subjected to wrought processing. Wrought processing inherently reduces or eliminates casting porosity while improving microstructure, and so the beneficial effect achieved by the present invention—enhancement of properties due to reduction in casting porosity—is not as great in this embodiment. Nonetheless, hot isostatic pressing of a previously wrought processed casting still containing residual casting porosity will further reduce this porosity, thereby improving its properties at least somewhat.

Although the present invention is applicable to castings of any size, it is particularly useful when practiced on "large" castings, i.e. castings whose minimum thickness dimension (including minimum wall thickness dimension in the case of hollow and other similar products) is at least 1 inch. Castings whose minimum thickness dimension is at least about 3 inches, and especially at least about 4 or 6 inches, are of particular interest. The rate at which heat can be extracted from a mass of metal in a mold depends, among other things, on the ratio of its volume to its surface area. Since "larger" castings generally have greater volume/surface area ratios, it typically takes longer to cool larger castings from their liquidus to solidus temperatures relative to smaller castings. The net effect is that it is more difficult to manufacture larger alloy castings than smaller castings, since the larger castings will spend longer periods of time in the semi-molten state. Casting porosity occurs while an alloy is in the semi-molten state, between its liquidus and solidus temperatures, and therefore larger castings are prone to more casting porosity than smaller castings. Accordingly, when a "large" casting is made from an alloy having a large differential between its liquidus and solidus temperatures, casting porosity becomes an especially significant problem, since both factors contributing to casting porosity are combined. The present invention, therefore, is especially applicable to manufacturing "large" castings from alloys having large differentials between their liquidus and solidus temperatures, since this is where the problem of casting porosity can be most pronounced.

Alloys

The present invention is applicable to castings made from high freezing range alloys—i.e., alloys having large differentials between their liquidus and solidus temperatures. Generally, this temperature differential will be at least 50° C. However, this differential may be 100° C. or more, or even 150° C. or more.

Many such alloy systems are known. Examples are aluminum-beryllium, copper-niobium, nickel-beryllium alloys and the like.

A particularly useful alloy in connection with the present invention is composed of a base metal comprising copper, nickel or aluminum plus up to about 75 wt. % beryllium. Preferred alloys of this type include at least about 90 wt. % base metal and up to about 10 wt. % Be or even 5 wt. % Be, and even up to about 3 wt. % Be. Especially preferred are copper alloys containing about 0.3 to 3.3 wt. % Be, nickel alloys containing about 0.4 to 4.3 wt. % Be and aluminum alloys containing about 1 to 75 wt. % Be. These alloys may contain additional elements such as Co, Si, Sn, W, Zn, Zr, Ti and others usually in amounts not exceeding 2 wt. %, preferably not exceeding 1 wt. %, per element. In addition, each of these base metal alloys can contain another of these base metals as an additional ingredient. For example, the Cu—Be alloy can contain Ni, Co and/or Al as an additional ingredient, again in an amount usually not exceeding 30 wt. %, more typically no more than 15 wt. %. Usually such alloys will have no more than 2 wt. %, and even more typically no more than 1 wt. % of this additional element.

These alloys are described, generally, in Harkness et al., Beryllium-Copper and Other Beryllium-Containing Alloys, *Metals Handbook*, Vol. 2, 10th Edition, © 1993 ASM International, the disclosure of which is incorporated by reference herein.

A preferred class of this type of alloy is the C81000 series and the C82000 series of high copper alloys as designated by the Copper Development Association, Inc. of New York, N.Y.

Another class of alloys that is especially useful in practicing the present invention is the spinodal alloys—i.e., alloys which spinodally decompose upon age hardening. A particularly interesting group of alloys of this type is the Cu—Ni—Sn spinodal alloys. These alloys, the most commercially important of which contain about 8 to 16 wt. % Ni and 5 to 8 wt. % Sn with the balance being Cu and incidental impurities, spinodally decompose upon final age hardening to provide alloys which are both strong and ductile as well as exhibiting good electrical conductivity, corrosion resistance in $Cl^-$, wear resistance and cavitation erosion resistant. In addition, they are machinable, grindable, platable and exhibit good non-sparking and anti-galling characteristics. These alloys are described in U.S. application Ser. No. 08/552,582, filed Nov. 3, 1995, the disclosure of which is also incorporated by reference. Especially preferred alloys of this type include those whose nominal compositions are 15Ni-8Sn—Cu (15 wt. % Ni, 8 wt. % Sn, balance Cu) and 9Ni-6Sn—Cu, which are commonly known as Alloys C96900 and C72700 under the composition designation scheme of the Copper Development Association. In addition to Ni and Sn, these alloys may also contain additional elements for enhancing various properties in accordance with known technology as well as incidental impurities. Examples of additional elements are B, Zr, Mn, Nb, Mg, Si, Ti and Fe.

Hot Isostatic Pressing

Hot isostatic pressing is carried out in accordance with the present invention by applying a high, uniform force to the surfaces of the article to be treated in a manner which does not materially alter its shape or cause gross material flow. Most easily, this is done by subjecting the article to a high pressure fluid such as argon or other inert gas. Liquids can also be used, and in this case it is also desirable that the liquid be essentially non-reactive with respect to the article. Avoiding fluids including reactive components such as oxygen helps prevent severe oxidation or other reaction of the alloy which might otherwise occur.

Although hot isostatic pressing can be carried out at any temperature, it is desirable the temperature be below the alloy's solidus temperature. Otherwise, a portion of the alloy might liquefy which could lead to cast shape distortion if not adequately supported. In addition, porosity may reappear if the casting is resolidified under insufficient pressure. In addition, it is also desirable that the temperature be above the alloy's solvus temperature, as this promotes uniform distribution of alloy components. In addition, this also avoids spinodal decomposition or other hardening phenomenon, which might occur in those alloys capable of undergoing such changes.

Hot isostatic pressing should be carried out long enough to cause a noticeable improvement in the porosity of the casting. In the following working examples, the porosity of a casting is measured by determining the normalized count per square centimeter of pores having a diameter greater than 100 microns at 50× magnification in a section cut from the casting. Other conventional ways of measuring porosity can also be used. Regardless of the particular method used, hot isostatic pressing should be carried out long enough to cause a noticeable reduction in the porosity of the casting, preferably a reduction of at least 50%, even more preferably at least 75%. It is also desirable to minimize the time at high temperature during hot isostatic pressing to prevent undesirable grain growth, consistent with promoting uniform distribution of segregated alloy components.

Any pressure which is high enough to collapse porosity can be used for accomplishing hot isostatic pressing. As a practical matter, these pressures are limited to those that can generated by commercially available HIP furnaces. At the elevated temperatures normally employed in carrying out hot isostatic pressing in accordance with the present invention., these pressures typically range from about 15,000 to 60,000 psig. Higher pressures can, of course, be used.

Hot isostatic pressing in accordance with the present invention can be carried out anytime during parts manufacture. As appreciated by skilled metallurgists, forming useful products from as cast alloys usually involves one or more heat processing steps including homogenization, solution annealing and, in some instances, precipitation hardening. In homogenization, the alloy is heated for a relatively long period of time (e.g. 4 hours to several days) at a temperature above the Solvus but below the Solidus temperatures. The objective of homogenization is to eliminate the microsegregation of elements which inherently occurs when the alloy is cast. Accordingly, heating is carried for a relatively long time to allow significant movement of solute atoms towards homogeneous distribution. Quenching may be rapid or slow.

In solution annealing, the alloy is also heated between the Solvus and Solidus temperatures. However, the primary objective is to freeze a homogeneous distribution of the alloy constituents in place, and so rapid quench of the alloy is required. Normally this is done with a water quench but other materials such as oil, cooling gas and the like can be used. Solution annealing normally presupposes that the alloy already starts with a fairly uniform element distribution, and so any heating needed to re-dissolve elements that may have segregated is minor. Therefore, heating times in solution annealing (on the order of a few minutes to an hour or so) are usually significantly shorter than in conventional homogenization.

Precipitation hardening is a phenomenon which may occur is some alloys when heated at relatively low temperature (315°–705° C. for 1 to 10 hours in the case of Be—Ni alloys mentioned above) after final solution annealing. Provided that the distribution of ingredients in the alloy is sufficiently uniform, low temperature heating will promote nucleation and growth of fine precipitates (nickel beryllide in the case of the above-noted Be—Ni alloys) which in turn will enhance the properties of the alloy produced.

In addition to these heat treating steps, the alloys may also be wrought processed, i.e. subjected to significant uniform mechanical deformation on the order of 40% or more in terms of area reduction. Wrought processing may be done between the Solvus and Solidus temperatures ("hot working") or at much lower temperatures ("cold working") such as room temperature. Hot working is normally done prior to final solution anneal before or after initial solution anneal, while cold work is normally done after final solution anneal. As indicated above, wrought processing may significantly change the alloy's crystal structure and properties in addition to changing its shape. In some instances, cold working may also enhance the effect of a subsequent precipitation hardening treatment.

The hot isostatic pressing step of the present invention can be carried out anytime during parts manufacture. Thus, hot isostatic pressing can be carried out before or after homogenization as well as before or after final solution anneal. If the casting is wrought processed before final solution anneal, hot isostatic pressing can be carried out before or after wrought processing. In alloys which precipitation harden, hot isostatic pressing is preferably done before precipitation hardening.

In a preferred embodiment of the invention, however, hot isostatic pressing is carried out in combination with or as part of the homogenization and/or solution annealing procedures. Since the temperature used for hot isostatic pressing in accordance with the present invention is preferably the same as the temperatures used for homogenization and solution annealing, i.e. between the solidus and solvus temperatures, hot isostatic pressing can be carried out simultaneously with these heat treatment steps.

Hot Isostatic Pressing of Turbocast Spinodal Alloys

An especially beneficial application of the present invention involves hot isostatic pressing of the large, continuously cast, spinodally-hardenable Cu—Ni—Sn ingots made by the technology of the above-noted U.S. application Ser. No. 08/552,582, filed Nov. 3, 1995.

In order to effect good spinodal decomposition of the Cu—Ni—Sn alloys described in that application, it is necessary that the alloys have a relatively fine, uniform grain structure when subjected to age hardening. In prior technology, this enhanced grain structure was achieved by significant mechanical deformation (wrought processing) of the as cast ingot prior to age hardening. However, wrought processing inherently limits the size and complexity of the products which can be produced due to practical constraints on the size and expense of the wrought processing equipment. In the technology of U.S. Ser. No. 08/552,582, molten alloy is introduced into the continuous casting die in a manner such that turbulence is created in zone where the liquid alloy solidifies into solid (referred to hereinafter as "turbocasting"). As a result, a relatively fine, uniform grain structure is achieved in the as cast ingot without wrought processing, thereby making a separate wrought processing step prior to age hardening unnecessary. Accordingly, final products with good spinodal properties can be achieved in bigger sizes and/or more complex shapes, since constraints due to wrought processing before age hardening have been eliminated.

In an especially preferred embodiment of this invention, large size, near net shape Cu—Ni—Sn castings (i.e. ingots or sections of ingots) made by the tubocasting procedure of this application are subjected to hot isostatic pressing, preferably before spinodal decomposition. This enables final products with good spinodal properties to be achieved not only in bigger sizes and/or more complex shapes than possible before, but also with even better properties. Thus, near net shape parts whose minimum thickness dimension (minimum wall thickness in the case of hollow parts) is at least ⅜ inch, more typically at least 1 inch, and even 4 inches or more, can be made with even better properties by adopting the technology of the present invention.

WORKING EXAMPLES

In order to more thoroughly describe the present invention, the following working examples are provided. In these examples, the alloys described in the following Table 1 were used.

TABLE 1

| Alloy Compositions | | | | |
|---|---|---|---|---|
| Alloy Composition | ALLOY I 9Ni-6Sn-Cu | | ALLOY II* 15Ni-8Sn-Cu | |
| Liquidus | 1100° C. | 2021° F. | 1115° C. | 2039° F. |
| Solidus | 925° C. | 1697° F. | 950° C. | 1742° F. |
| Solvus | 740° C. | 1364° F. | 800° C. | 1472° F. |

*Alloy C96900

Examples 1 to 4

Molten Alloy I was continuously cast using the turbocasting procedure of U.S. Ser. No. 08/552,582 to produce three solid cylindrical ingots nominally 24 inches in diameter. These ingots were then sectioned into circular plates, which were then subjected to hot isostatic pressing in accordance with the present invention at 15,000 psig at 1475 to 1550° F. for 4 hours, after which the plates were spinodally hardened to HRC 26 to 32 by heating at 700° F. for 6 hours. The plates were examined microscopically at various radial locations along the plate surfaces, before and after hot isostatic pressing, and the number of pores greater than 100 microns in diameter were recorded.

The results obtained are set forth in the following Table 2.

TABLE 2

Porosity of Hot Isostatically Pressed Turbocast Ingots of Alloy I

| Ex. | INGOT | INGOT HISTORY | HIP TEMP ° F. | LOCATION OF MEASUREMENT | PORES/SQCM W/O HIP | PORES/SQCM WITH HIP |
|---|---|---|---|---|---|---|
| 1 | A | HIP'd as cast | 1550 | Outer Diameter | 8 | 4 |
| | | | | Centerline | 28 | 7 |
| 2 | A | HIP'd as cast | 1475 | Outer Diameter | 3 | 1 |
| | | | | Centerline | 29 | 2 |
| 3 | B | Section of ingot HIP'd | 1550 | Outer Diameter | 0 | 0 |
| | | | | Mid-Radius | 26 | 0 |
| | | | | Centerline | 17 | 0 |
| 4 | C | Ingot section sol'n annealed, then HIP'd | 1550 | Outer Diameter | 19 | 0 |
| | | | | Mid-Radius | 16 | 0 |
| | | | | Centerline | 15 | 0 |

From Table 2, it can be seen that application of hot isostatic pressing to turbocast ingots in accordance with the present invention significantly reduces casting porosity.

Examples 5 and 6 and Comparative Example A

Molten Alloy II was continuously cast using the turbocasting procedure of U.S. Ser. No. 08/552,582 to produce a hollow cylindrical ingot 5.5 inches in outer diameter and having a wall thickness of 1.375 inches. Right sections of this as-cast ingot 22 inches long were then subjected to hot isostatic pressing in accordance with the present invention at 15,000 psig at 1475 to 1550° F. for 4 hours. Next, the sections were spinodally hardened to a hardness between HRC 32 to 35 by heating at 740° F. for 3 hours. Finally, the sections were subjected to the fatigue test of ASTM E466 "Standard Practice for Conducting Constant Amplitude Axial Fatigue Tests of Metallic Materials." A section not having been subjected to hot isostatic pressing was also tested for the purposes of comparison.

The results obtained are set forth in the following Table 3.

TABLE 3

Fatigue Properties of Hot Isostatically Pressed Turbocast Tube of Alloy II

| EXAMPLE | HIP TEMP. ° F. | MEAN No. OF CYCLES TO FAILURE (log) FAILURE AT 40 KSI | FAILURE AT 60 KSI |
|---|---|---|---|
| 5 | 1550 | 7.36 | 4.93 |
| 6 | 1475 | 7.72 | 5.15 |
| Comp A | — | 5.89 | 4.93 |

From Table 3, it can be seen that hot isostatic pressing significantly enhanced the rotating beam fatigue of these ingots relative to ingots not subjected to such processing.

Although only a few embodiments of the present invention have been described above, it should be appreciated that many modifications can be made without departing from the spirit and scope of the invention. All such modifications are intended to be included within the scope of the present invention, which is to be limited only by the following claims.

I claim:

1. A process for enhancing the properties of a casting made by turbocasting a molten alloy composed of 8 to 16 wt. % Ni and 5 to 8 wt. % Sn, with the balance being Cu and incidental impurities, the process comprising subjecting the casting to hot isostatic pressing.

2. The process of claim 1, wherein the casting has a minimum thickness dimension of at least 1 inch.

3. The process of claim 2, wherein the casting is unwrought.

4. The process of claim 3, wherein the casting is subjected to hot isostatic pressing without prior spinodal decomposition.

5. The process of claim 2, wherein the casting is subjected to hot isostatic pressing without prior spinodal decomposition.

6. The process of claim 1, wherein hot isostatic pressing of the casting is accomplished such that the porosity of the casting decreases at least 50%, as measured by the number per square centimeter of pores having a diameter greater than 100 microns.

* * * * *